US010835943B2

(12) United States Patent
Barker

(10) Patent No.: US 10,835,943 B2
(45) Date of Patent: Nov. 17, 2020

(54) TRAY BENDER

(71) Applicant: Shon Barker, Cameron, LA (US)

(72) Inventor: Shon Barker, Cameron, LA (US)

( * ) Notice: Subject to any disclaimer, the term of this patent is extended or adjusted under 35 U.S.C. 154(b) by 201 days.

(21) Appl. No.: 16/010,394

(22) Filed: Jun. 15, 2018

(65) Prior Publication Data

US 2018/0361450 A1 Dec. 20, 2018

Related U.S. Application Data

(60) Provisional application No. 62/520,264, filed on Jun. 15, 2017.

(51) Int. Cl.
*B21D 5/00* (2006.01)
*B25B 33/00* (2006.01)
*B21D 19/00* (2006.01)

(52) U.S. Cl.
CPC ..... *B21D 5/00* (2013.01); *B21D 19/00* (2013.01); *B25B 33/00* (2013.01)

(58) Field of Classification Search
CPC .. B25B 33/00; B25B 9/00; B21D 5/00; B21D 19/00; B21F 1/06
USPC ..... 72/409.18, 407, 409.01, 457, 458, 479, 72/476; 140/123, 147; 254/21, 25; 80/20
See application file for complete search history.

(56) References Cited

U.S. PATENT DOCUMENTS 4,956,905 A * 9/1990 Davidson ..... A01D 34/001 29/213.1
5,212,860 A * 5/1993 Lakey ..... B25B 9/00 29/270
5,611,237 A * 3/1997 Harper ..... B21D 19/02 72/458
5,695,230 A * 12/1997 Thompson ..... B65G 7/12 254/131
5,934,138 A * 8/1999 Semien ..... B21D 7/063 72/458
10,391,536 B1 * 8/2019 Hubbard ..... B21D 11/20
2016/0031646 A1 * 2/2016 Brock ..... B25J 1/04 294/209

* cited by examiner

*Primary Examiner* — Teresa M Ekiert
*Assistant Examiner* — Sarkis A Aktavoukian

(57) ABSTRACT

A tray bender allows a user to easily and efficiently bend a tubing tray or similar item. The tray bender includes a shaft and a tray-bending head. The shaft is an elongated, tubular structure which acts as a gripping element of the tray bender. The tray-bending head is a specifically designed structure which is used to engage the tray bender with a tubing tray or similar item. The user can apply an input force onto the end of the shaft opposite to the tray-bending head in order to provide a torque force to bend a tubing tray or similar. The tray-bending head is designed with prong-like structures with a gap space in between each prong-like structure to receive a tubing tray or similar item.

13 Claims, 6 Drawing Sheets

TRAY BENDER

The current application claims a priority to the U.S. Provisional Patent application Ser. No. 62/520,264 filed on Jun. 15, 2017.

FIELD OF THE INVENTION

The present invention relates generally to tools. More specifically, the present invention is a tray bender which allows a user to easily and efficiently bend a tray.

BACKGROUND OF THE INVENTION

A tool is an item that is used to accomplish a physical goal. There are various tools which are manufactured for a specific purpose. For example, a screwdriver may be used to fasten or unfasten screws, or a wrench may be used to fasten or unfasten nuts. There are a number of tools that may be used for a purpose not primarily intended for the tool. However, this may lead to damage caused to either the tool or the item engaged by the tool. In particular, an item that may be engaged by a tool for a specific purpose is a tubing tray or similar. In further detail, a tool such as a set of pliers may be incorrectly used to bend a tubing tray which may damage either the set of pliers or the tubing tray. There exists a need for a tool that is intended for bending a tubing tray or similar.

Therefore, it is the objective of the present invention to provide a tray bender which allows a user to easily and efficiently bend a tray. The tray bender includes a head that can engage to a tray and a handle for leverage when applying a torque force to the tray. The tray bender includes multiple embodiments which allows right-hand or left-hand dominant users to bend a tray at different angles.

DETAIL DESCRIPTIONS OF THE INVENTION

All illustrations of the drawings are for the purpose of describing selected versions of the present invention and are not intended to limit the scope of the present invention.

In reference to FIGS. 1 through 6, the present invention is a tray bender which allows a user to easily and efficiently bend a tray. More specifically, the present invention is primarily used to bend galvanized, stainless steel, or aluminum tubing trays. The present invention is preferably composed of stainless steel. The present invention includes a shaft 1 and a tray-bending head 2. The shaft 1 is an elongated, tubular structure which acts as a gripping element for the user. The tray-bending head 2 provides a specifically-designed structure which is used to easily and efficiently bend a tray.

Figure 1:
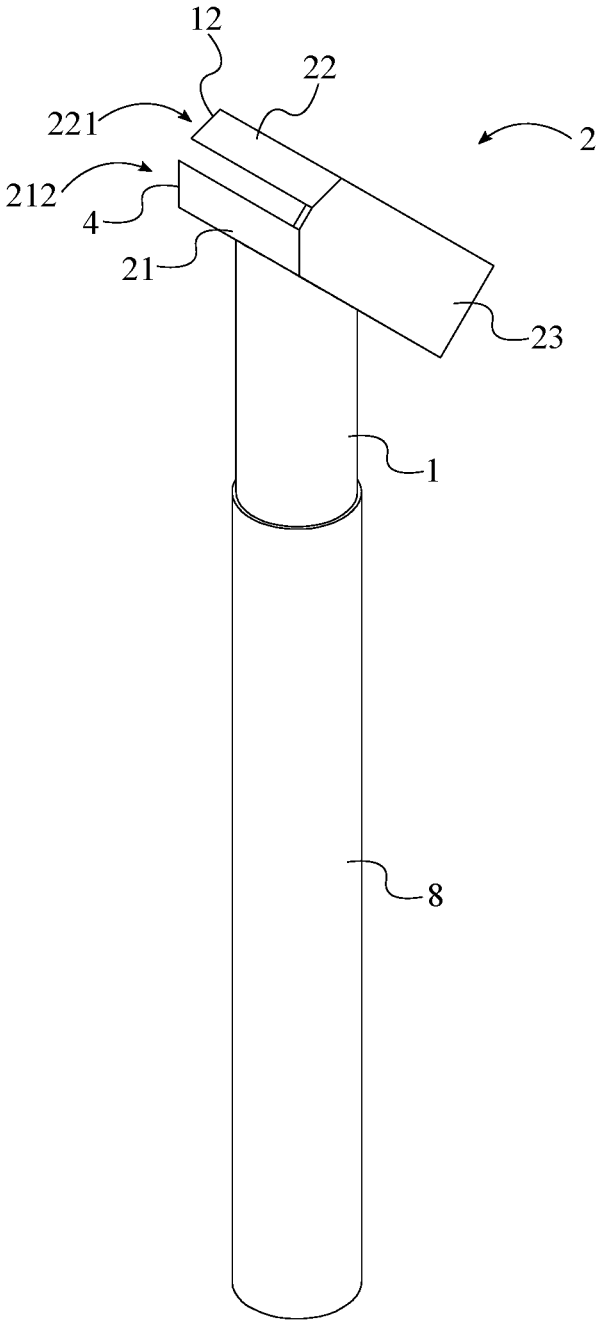
FIG. 1 is a side perspective view of the present invention, wherein the shaft is at a positive 45-degree angle with the leverage-referencing axis.
Figure 2:
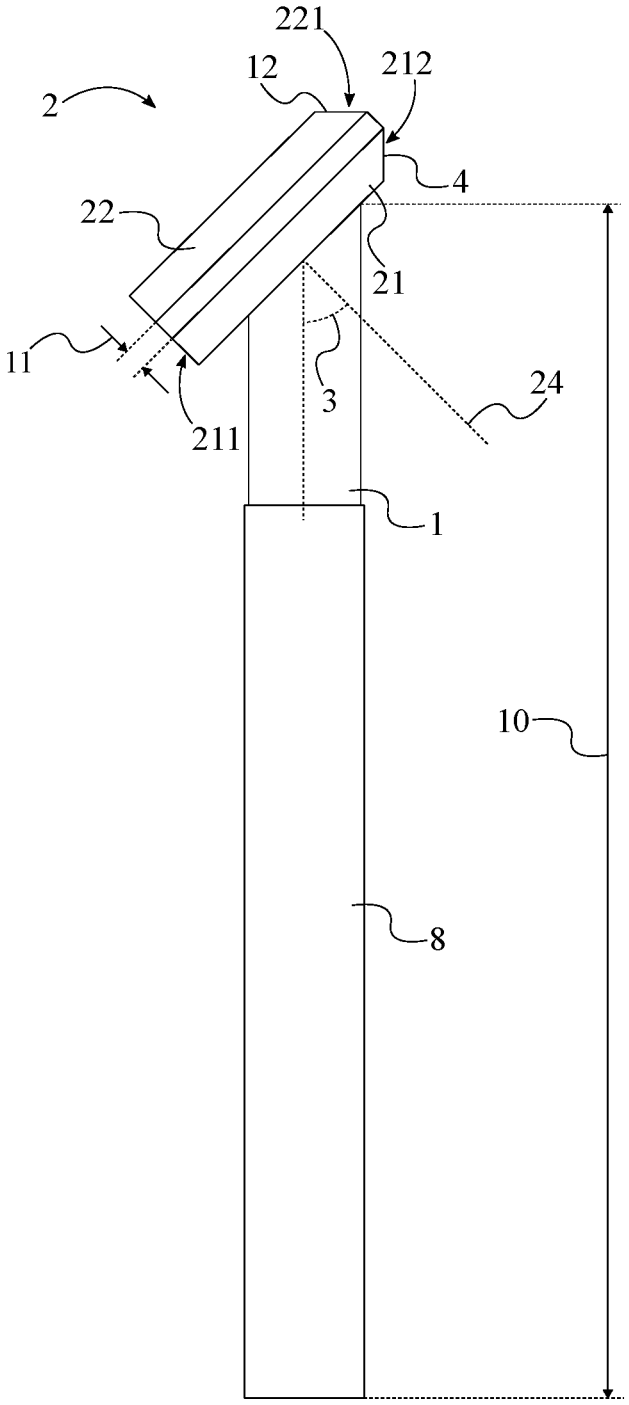
FIG. 2 is a side view of the present invention thereof.

The general configuration of the aforementioned components allows a user to effectively and efficiently bend a tray. With reference to FIGS. 1 and 2, the tray-bending head 2 comprises a first planar brace 21, a second planar brace 22, a web 23, and a leverage-referencing axis 24. The first planar brace 21 and the second planar brace 22 are preferably prong-like structures which are used to fit the present invention into empty spaces of a tray in order to bend the tray. The web 23 links the first planar brace 21 with the second planar brace 22. The leverage-referencing axis 24 is a center axis where the greatest torque can be the user when the present invention is engaged to a tray. The first planar brace 21 is terminally connected to the shaft 1, which allows the user to apply the maximum amount of torque with the present invention while bending a tray. The first planar brace 21 and the second planar brace 22 are positioned offset to each other in order to create a gap space which can receive a tray. The web 23 is positioned between the first planar brace 21 and the second planar brace 22 and connected perpendicular to the first planar brace 21 and the second planar brace 22 in order to form a U-shaped body for the tray-bending head 2 that is able to receive and securely grasp a tray. The leverage-referencing axis 24 is positioned normal to the first planar brace 21 and the second planar brace 22 and centrally positioned to the first planar brace 21. Consequently, this ensures that maximum point of leverage is used when bending a tray. The web 23 is positioned offset from the leverage-referencing axis 24. This allows the leverage-referencing axis 24 to be a fulcrum as the first planar brace 21 and the second planar brace 22 press against opposing sides of a tray With reference to FIG. 2 and in order to provide a leverage angle for the user to bend a tray, the shaft 1 is oriented at a first angle 3 with the leverage-referencing axis 24. This arrangement allows the user to bend a tray at an angle. In a first embodiment of the present invention, the first angle 3 is 45 degrees in order for right-hand dominant users to bend a tray at an acute angle. In this embodiment, the present invention may further comprise a first sloped brace 4. The first sloped brace 4 provides the tray-bending head 2 with a larger engagement surface to contact a tray and generates more leverage when bending the tray. The first planar brace 21 comprises a proximal edge 211 and a distal edge 212 which are positioned opposite to each other across the first planar brace 21. The shaft 1 is positioned between the proximal edge 211 and the leverage-referencing axis 24. The first sloped brace 4 is integrated into the distal edge 212. This arrangement orients the first sloped brace 4 and the shaft 1 in opposing directions so that the fulcrum of the leverage generated by the present invention is centered about the leverage-referencing axis 24. In this embodiment, the present invention may further comprise a second sloped brace 12. The second sloped brace 12 and the first sloped brace 4 act as gripping elements when the present invention is engaged to a tray. Furthermore, the first sloped brace 4 and the second sloped brace 12 prevent the tray from breaking while being bent by the present invention. A peripheral edge 221 of the second planar brace 22 is positioned adjacent and along the distal edge 212. The second sloped brace 12 is integrated into the peripheral edge 221. This arrangement aligns the second sloped brace 12 with the first sloped brace 4.

Figure 3:
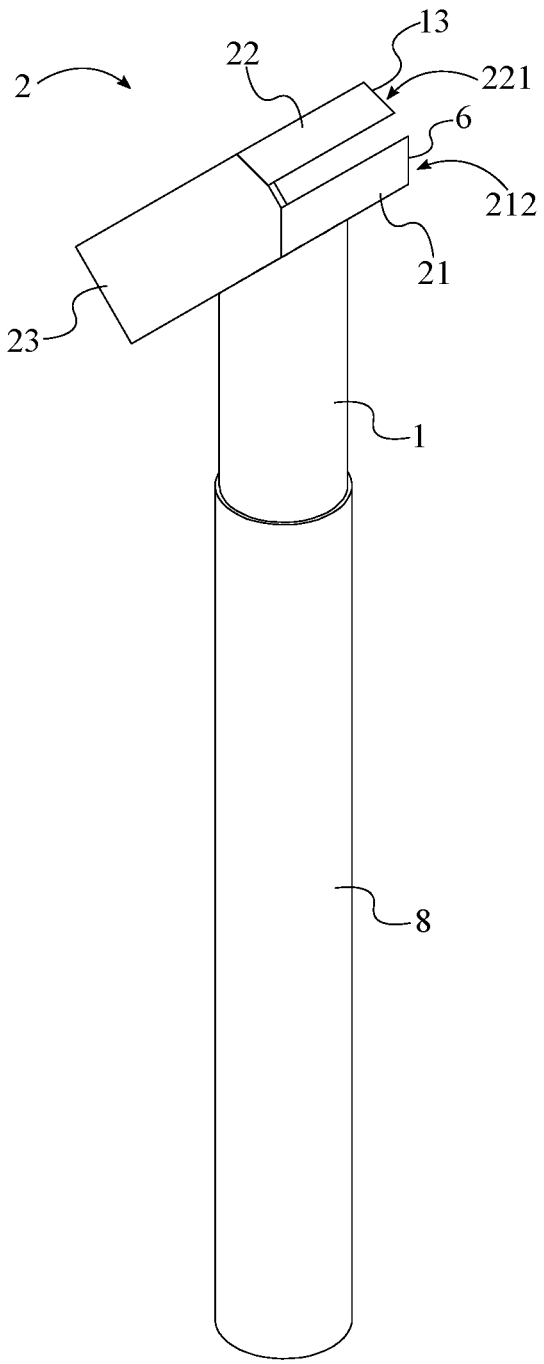
FIG. 3 is a side perspective view of the present invention, wherein the shaft is at a negative 45-degree angle with the leverage-referencing axis.
Figure 4:
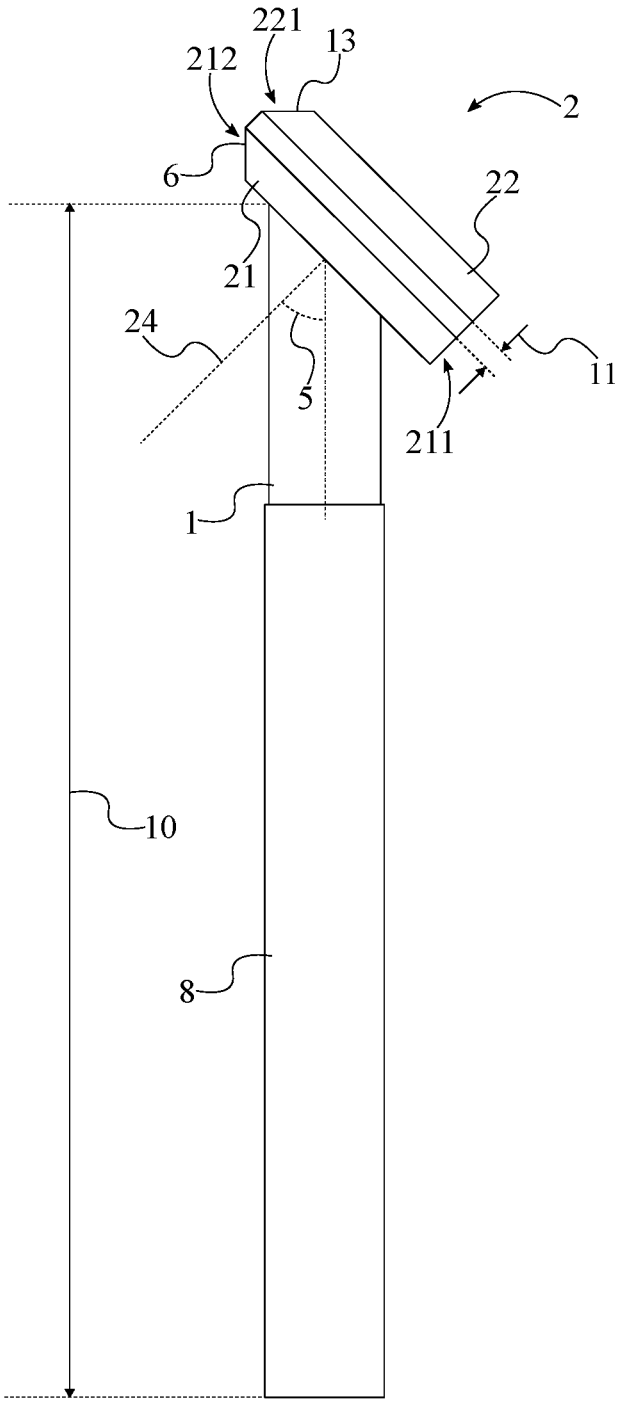
FIG. 4 is a side view of the present invention thereof.

With reference to FIGS. 3 and 4 and in order to provide a different leverage angle for the user to bend a tray, the shaft 1 is oriented at a second angle 5 with the leverage-referencing axis 24. This arrangement allows the user to bend a tray at an angle. In a second embodiment of the present invention, the second angle 5 is −45 degrees in order for left-hand dominant users to bend a tray at an acute angle. In this embodiment, the present invention may further comprise a third sloped brace 6. Similar to the first sloped brace 4, the third sloped brace 6 provides the tray-bending head 2 with a larger engagement surface to contact a tray and generates more leverage when bending the tray. The first planar brace 21 comprises a proximal edge 211 and a distal edge 212 which are positioned opposite to each other across the first planar brace 21. The shaft 1 is positioned between the proximal edge 211 and the leverage-referencing axis 24. The third sloped brace 6 is integrated into the distal edge 212. This arrangement orients the third sloped brace 6 and the shaft 1 in opposing directions so that the fulcrum of the leverage generated by the present invention is centered about the leverage-referencing axis 24. In this embodiment, the present invention may further comprise a fourth sloped brace 13. The third sloped brace 6 and the fourth sloped brace 13 act as gripping elements when the present invention is engaged to a tray. Furthermore, the third sloped brace 6 and the fourth sloped brace 13 prevent the tray from breaking while being bent by the present invention. A peripheral edge 221 of the second planar brace 22 is positioned adjacent and along the distal edge 212. The fourth sloped brace 13 is integrated into the peripheral edge 221. This arrangement aligns the fourth sloped brace 13 with the third sloped brace 6.

Figure 5:
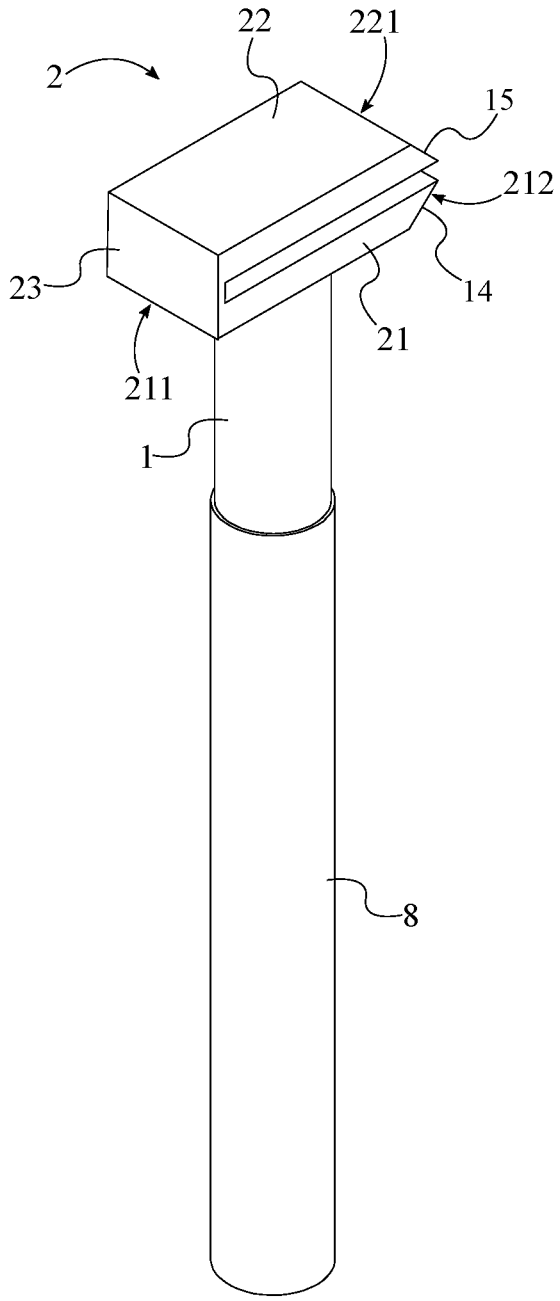
FIG. 5 is a side perspective view of the present invention, wherein the shaft is at a straight angle with the leverage-referencing axis.
Figure 6:
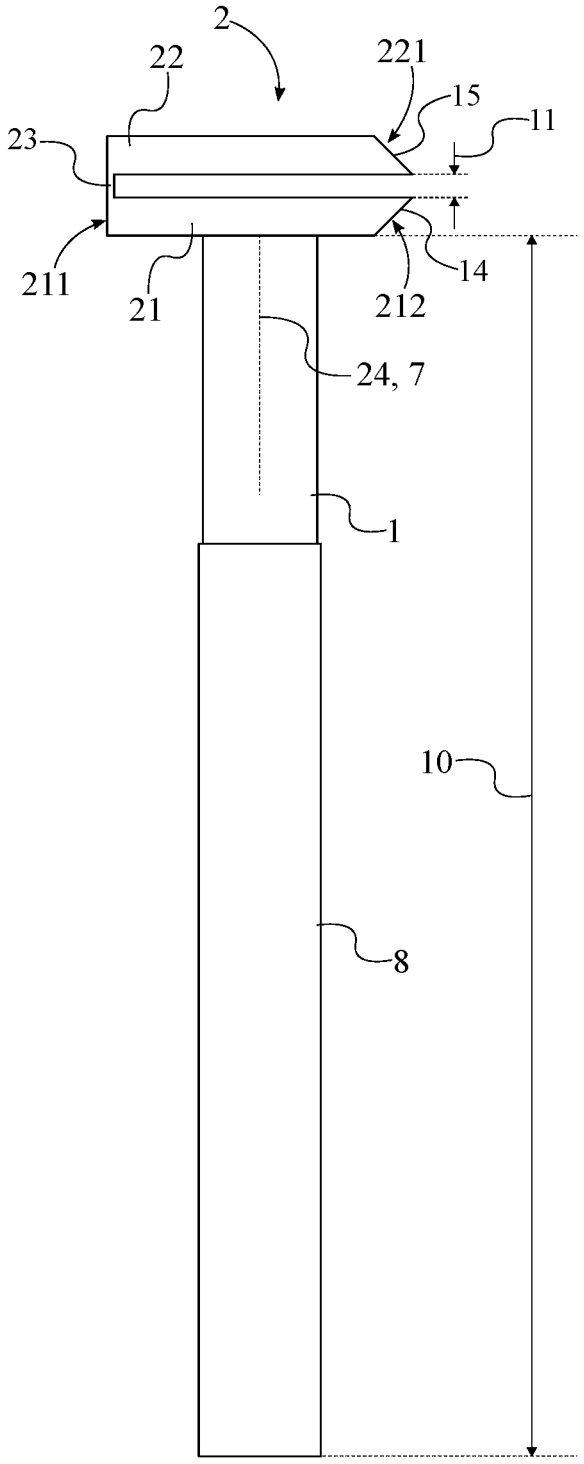
FIG. 6 is a side view of the present invention thereof.

With reference to FIGS. 5 and 6 and in order to provide a different leverage angle for the user to bend a tray, the shaft 1 is oriented at a third angle 7 with the leverage-referencing axis 24. This arrangement allows the user to bend a tray at an angle. In a third embodiment of the present invention, the third angle 7 is a straight angle in order for left-handed and right-handed users to bend a tray at a straight angle. In this embodiment, the present invention may further comprise a fifth sloped brace 14. Similar to the first sloped brace 4, the fifth sloped brace 14 provides the tray-bending head 2 with a larger engagement surface to contact a tray and generates more leverage when bending the tray. The first planar brace 21 comprises a proximal edge 211 and a distal edge 212 which are positioned opposite to each other across the first planar brace 21. The shaft 1 is positioned between the proximal edge 211 and the leverage-referencing axis 24. The fifth sloped brace 14 is integrated into the distal edge 212. This arrangement orients the fifth sloped brace 14 and the shaft 1 in opposing directions so that the fulcrum of the leverage generated by the present invention is centered about the leverage-referencing axis 24. In this embodiment, the present invention may further comprise a sixth sloped brace 15. The fifth sloped brace 14 and the sixth sloped brace 15 act as gripping elements when the present invention is engaged to a tray. Furthermore, the fifth sloped brace 14 and the sixth sloped brace 15 prevent the tray from breaking while being bent by the present invention. A peripheral edge 221 of the second planar brace 22 is positioned adjacent and along the distal edge 212. The sixth sloped brace 15 is integrated into the peripheral edge 221. This arrangement aligns the sixth sloped brace 15 with the fifth sloped brace 14.

As seen in FIG. 1, the present invention may further comprise a sleeve 8. The sleeve 8 may be composed of any material such as, but not limited to, rubber material. The sleeve 8 provides a comfortable surface for the user to grip when using the present invention. The shaft 1 is mounted within the sleeve 8 in order for the palm of the user to make direct contact with the sleeve 8 rather than the shaft 1 when using the present invention.

With reference to FIG. 2 and in order for a tray to not slip out of the tray-bending head 2 when the present invention is engaged to the tray, the first planar brace 21 and the second planar brace 22 are positioned coextensive with each other. This arrangement restricts the first planar brace 21 to be the same size as the second planar brace 22 which prevents a tray from accidentally slipping out from the tray-bending head 2. The web 23 is peripherally positioned on the first planar brace 21 and the second planar brace 22. This arrangement provides the maximum amount of engagement surface to a tray between the first planar brace 21 and the second planar brace 22.

In order for the present invention to be physically able to bend a tray, the shaft 1 and the tray-bending head 2 are preferably made of stainless steel. The material composition of the shaft 1 and tray-bending head 2 provides the tray-bending head 2 and the shaft 1 mechanical properties which make the present invention strong enough to bend a tray. In further detail, the shaft 1 and the tray-bending head 2 do not break when applying torque to a tray when using the present invention.

With reference to FIGS. 2, 4, and 6 and in order for the user to provide enough torque to the tray using the present invention, a ratio between a length 10 of the shaft 1 and an offset distance 11 between the first planar brace 21 and the second planar brace 22 is 1:51.2. The length 10 of the shaft 1 is preferably 8 inches, and the offset distance 11 between the first planar brace 21 and the second planar brace 22 is 5/32 inches in order for the user to provide enough torque. In further detail, the length 10 of the shaft 1 amplifies the input force to provide a greater torque force when using the present invention.

Although the invention has been explained in relation to its preferred embodiment, it is to be understood that many other possible modifications and variations can be made without departing from the spirit and scope of the invention as hereinafter claimed.

What is claimed is:

1. A tray bender comprising:

a shaft;

a tray-bending head;

the tray-bending head comprising a first planar brace, a second planar brace, a web, and a leverage-referencing axis;

the first planar brace being terminally connected to the shaft;

the first planar brace and the second planar brace being positioned offset to each other;

the web being positioned between the first planar brace and the second planar brace;

the web being connected perpendicular to the first planar brace and the second planar brace;

the leverage-referencing axis being positioned normal to the first planar brace and the second planar brace;

the leverage-referencing axis being centrally positioned to the first planar brace;

the web being positioned offset from the leverage-referencing axis;

wherein a ratio between a length of the shaft and an offset distance between the first planar brace and the second planar brace is 1:51.2, the length of the shaft is 8 inches, and the offset distance between the first planar brace and the second planar brace is 5/32 inches.

2. The tray bender as claimed in claim 1 comprising:

the shaft being oriented at a first angle with the leverage-referencing axis;

the first angle being 45 degrees.

3. The tray bender as claimed in claim 2 comprising:
a first sloped brace;
the first planar brace comprising a proximal edge and a distal edge;
the shaft being positioned in between the proximal edge and the distal edge;
the distal edge being positioned opposite to the proximal edge across the first planar brace;
the first sloped brace being integrated into the distal edge.

4. The tray bender as claimed in claim 3 comprising:
a second sloped brace;
a peripheral edge of the second planar brace being positioned adjacent and along the distal edge;
the second sloped brace being integrated into the peripheral edge.

5. The tray bender as claimed in claim 1 comprising:
the shaft being oriented at a second angle with the leverage-referencing axis;
the second angle being −45 degrees.

6. The tray bender as claimed in claim 5 comprising:
a third sloped brace;
the first planar brace comprising a proximal edge and a distal edge;
the shaft being positioned in between the proximal edge and the distal edge;
the distal edge being positioned opposite to the proximal edge across the first planar brace;
the third sloped brace being integrated into the distal edge.

7. The tray bender as claimed in claim 6 comprising:
a fourth sloped brace;
a peripheral edge of the second planar brace being positioned adjacent and along the distal edge;
the fourth sloped brace being integrated into the peripheral edge.

8. The tray bender as claimed in claim 1 comprising:
the shaft being oriented at a third angle with the leverage-referencing axis;
the third angle being a straight angle.

9. The tray bender as claimed in claim 8 comprising:
a fifth sloped brace;
the first planar brace comprising a proximal edge and a distal edge;
the distal edge being positioned opposite to the proximal edge across the first planar brace;
the proximal edge being positioned adjacent to the web;
the fifth sloped brace being integrated into the distal edge.

10. The tray bender as claimed in claim 9 comprising:
a sixth sloped brace;
a peripheral edge of the second planar brace being positioned adjacent and along the distal edge;
the sixth sloped brace being integrated into the peripheral edge.

11. The tray bender as claimed in claim 1 comprising:
a sleeve;
the shaft being mounted within the sleeve.

12. The tray bender as claimed in claim 1 comprising:
the first planar brace and the second planar brace being positioned coextensive with each other;
the web being peripherally positioned on the first planar brace;
the web being peripherally positioned on the second planar brace.

13. The tray bender as claimed in claim 1, wherein the shaft and the tray-bending head each is made of stainless steel.

* * * * *